US008087738B2

(12) United States Patent
Henriott et al.

(10) Patent No.: US 8,087,738 B2
(45) Date of Patent: Jan. 3, 2012

(54) CASEGOODS WITH CABLE MANAGEMENT FEATURES

(75) Inventors: Jay M. Henriott, Jasper, IN (US); Kevin T. Rauscher, Celestine, IN (US); Airen R. Springer, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 984 days.

(21) Appl. No.: 11/419,607

(22) Filed: May 22, 2006

(65) Prior Publication Data

US 2006/0261712 A1 Nov. 23, 2006

Related U.S. Application Data

(60) Provisional application No. 60/683,748, filed on May 23, 2005.

(51) Int. Cl.
*A47B 13/00* (2006.01)

(52) U.S. Cl. ..... 312/223.6; 312/223.3; 312/194; 108/50.02

(58) Field of Classification Search ..... 312/257.1, 312/258, 265.6, 194, 195, 262, 223.3, 223.6, 312/294, 259; 108/50.01, 50.02
See application file for complete search history.

(56) References Cited

U.S. PATENT DOCUMENTS

| | | | | | |
|---|---|---|---|---|---|
| D4,212 | S | | 7/1870 | Seymour | |
| 1,786,823 | A | | 12/1930 | Carrington et al. | |
| D165,243 | S | | 11/1951 | Porter | |
| 2,853,351 | A | * | 9/1958 | Bassett | 312/194 |
| D196,833 | S | | 11/1963 | Smith, Jr. | |
| D208,019 | S | | 7/1967 | Dottinger | |
| 3,635,174 | A | | 1/1972 | Ball et al. | |
| D223,372 | S | | 4/1972 | Allen | |
| 3,787,605 | A | | 1/1974 | Van Gessel et al. | |
| 3,865,051 | A | * | 2/1975 | Johl et al. | 108/132 |
| 4,040,692 | A | * | 8/1977 | Sass et al. | 312/194 |
| 4,163,867 | A | | 8/1979 | Breidenbach | |
| 4,323,291 | A | | 4/1982 | Ball | |
| D294,544 | S | | 3/1988 | Kyle | |
| D296,165 | S | | 6/1988 | Ferguson | |
| 4,827,850 | A | * | 5/1989 | Diffrient | 108/60 |
| 4,884,513 | A | | 12/1989 | Newhouse et al. | |
| D325,309 | S | | 4/1992 | Worrell | |
| 5,130,494 | A | | 7/1992 | Simonton et al. | |
| 5,144,896 | A | | 9/1992 | Fortsch | |
| 5,272,988 | A | | 12/1993 | Kelley et al. | |
| 5,277,131 | A | | 1/1994 | Fortsch | |
| 5,365,861 | A | * | 11/1994 | Gutgsell | 108/132 |
| D353,063 | S | | 12/1994 | Brinkmann | |
| D358,069 | S | | 5/1995 | Brinkmann | |

(Continued)

*Primary Examiner* — James O Hansen
(74) *Attorney, Agent, or Firm* — Baker & Daniels LLP

(57) ABSTRACT

Office and home office furniture casegood products having cable management features, such as a desk including pedestals with hinged access doors having one or more cable management grommets disposed in the top edges of the hinged access doors. The desk may also include a hinged modesty panel with one or more cable management grommets disposed in a top edge thereof. The cable management grommets include a plurality of cable management grommet apertures to facilitate routing of cords or cables through the cable management grommets. The desk may also include a work surface having a bottom surface with a plurality of cord troughs attached thereto. Various panels of the desk include half-round cord openings to facilitate routing of cords and cables after having been routed through the cable management grommet apertures. The modesty panel includes an offset hinge assembly, advantageously providing ease of access to a wall outlet located behind the modesty panel.

20 Claims, 7 Drawing Sheets

U.S. PATENT DOCUMENTS 5,429,431 A * 7/1995 Olson et al. ..... 312/223.6
5,451,101 A * 9/1995 Ellison et al. ..... 312/223.6
5,464,280 A * 11/1995 Runger ..... 312/249.11
5,632,540 A * 5/1997 Wilcox ..... 312/197
5,690,403 A 11/1997 Ellison et al.
5,741,053 A * 4/1998 Nielsen ..... 312/194
5,860,713 A * 1/1999 Richardson ..... 312/223.6
6,126,253 A * 10/2000 Kelley et al. ..... 312/195
6,133,528 A * 10/2000 Henriott et al. ..... 174/652
6,158,831 A * 12/2000 Brown et al. ..... 312/258
6,241,329 B1 6/2001 Nielsen
6,457,422 B1 10/2002 Saul
D473,728 S 4/2003 Chang
6,722,750 B2 * 4/2004 Chan ..... 312/258
6,953,231 B2 10/2005 Markofer
2002/0189505 A1 * 12/2002 Markofer ..... 108/50.01
2005/0231080 A1 * 10/2005 Torrance ..... 312/223.6

* cited by examiner

CASEGOODS WITH CABLE MANAGEMENT FEATURES

CROSS REFERENCE TO RELATED APPLICATIONS

This application claims the benefit under Title 35, U.S.C. §119(e) of U.S. Provisional Patent Application Ser. No. 60/683,748, entitled "CASEGOODS WITH CABLE MANAGEMENT FEATURES", filed May 23, 2005, the disclosure of which is expressly incorporated herein by reference.

BACKGROUND

1. Field of the Invention

The present invention relates to articles of office and home office furniture and, more particularly, to office and home office furniture casegoods which include cable management features.

2. Description of the Related Art

Office and home office furniture casegoods, such as desks, credenzas, and other furniture components, are typically provided with cable management systems to facilitate management of cords and cables associated with computers, telephones, and other electronic desk-mounted devices. Most conventional cable management systems rely on holes disposed in the work surface to manage the cables. The cables are routed through the holes in the work surface and drop below the work surface to a floor surface. In most instances, the cables are not well-organized and often are strewn about the floor surface. The cables must be plugged into a power strip which rests on the floor surface and is often physically in the way of a user's feet. Further, the cable management holes on the work surface can often be obstructions, for example, the holes may be positioned where a user desires to stack papers or perform work.

Known desks are also provided with modesty panels, which are either permanently attached to the desk or comprise a separate panel which may be removed from the desk when desired, such as to route and configure cables. When the modesty panel is permanently attached to the desk, it is often difficult to route cables underneath the modesty panel and, when the modesty panel is removable, same is often very heavy and cumbersome to move and, therefore, access to a wall outlet or other device located behind a modesty panel is limited and burdensome.

SUMMARY

The present invention provides office and home office furniture casegood products having cable management features, such as a desk including pedestals with hinged access doors having one or more cable management grommets or devices disposed in the top edges of the hinged access doors. The desk may also include a hinged modesty panel with one or more cable management grommets disposed in a top edge thereof. The cable management grommets may include a plurality of cable management grommet apertures to facilitate routing of cords or cables through the cable management grommets. The desk may also include a work surface having a bottom side with a plurality of cord troughs attached thereto. Various panels of the desk may include half-round cord openings to facilitate routing of cords and cables after having been routed through the cable management grommet apertures. The modesty panel may include an offset hinge assembly, advantageously providing ease of access to a wall outlet located behind the modesty panel.

In one embodiment, the present invention provides an article of furniture including a modesty panel, the modesty panel having a top edge and at least one hinge pivotally connecting the modesty panel to the article of furniture; and a cable management device, the management device disposed in the top edge of the modesty panel.

In another embodiment, the present invention provides an article of furniture including at least one pedestal; an access door associated with at least one of the at least one pedestal, the access door including at least one edge; and a cable management device, the management device disposed in the at least one edge of the access door.

In yet another embodiment, the present invention provides an article of furniture including at least one pedestal; at least one drawer associated with at least one of the at least one pedestal; and an access door mounted on a side of the at least one pedestal opposite the at least one drawer.

BRIEF DESCRIPTION OF THE DRAWINGS

The above mentioned and other features and objects of this invention, and the manner of attaining them, will become more apparent and the invention itself will be better understood by reference to the following description of exemplary embodiments of the invention taken in conjunction with the accompanying drawings, wherein.

Figure 1:
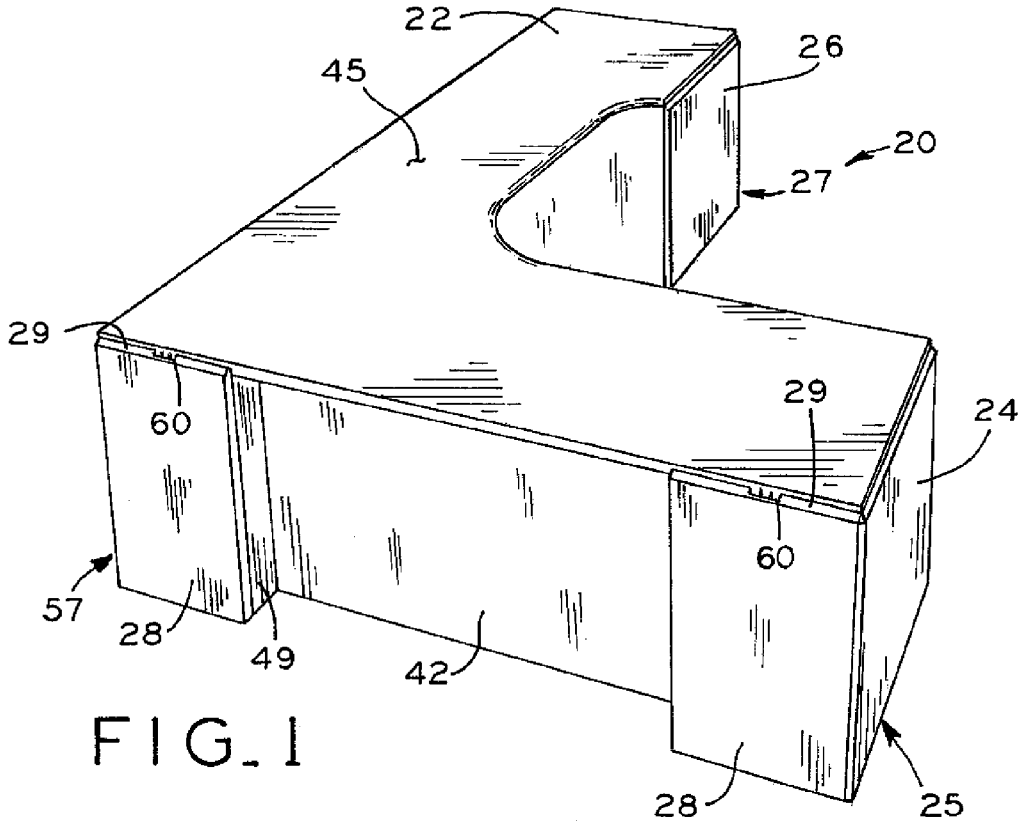
FIG. 1 is a perspective view of an exemplary office or home office furniture casegood, shown in the form of a desk.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, and such exemplifications are not to be construed as limiting the scope of the invention in any manner.

DETAILED DESCRIPTION

Referring now to FIG. 1, an exemplary casegood for offices or home offices is shown in the form of desk 20. Although shown and described herein as a desk, the casegood could also be a credenza, filing cabinet, bookcase, or other furniture component, and the features discussed below are equally applicable to any type of casegood product. Desk 20 may include work surface 22 supported by pedestals 25, 27, and 57. Top surface 45 of work surface 22 can accommodate any number of work-related items, such as various papers and electronic devices such as telephone 52 (FIG. 3) and computer monitor 50 with keyboard 48 (FIG. 3).

Figure 2:
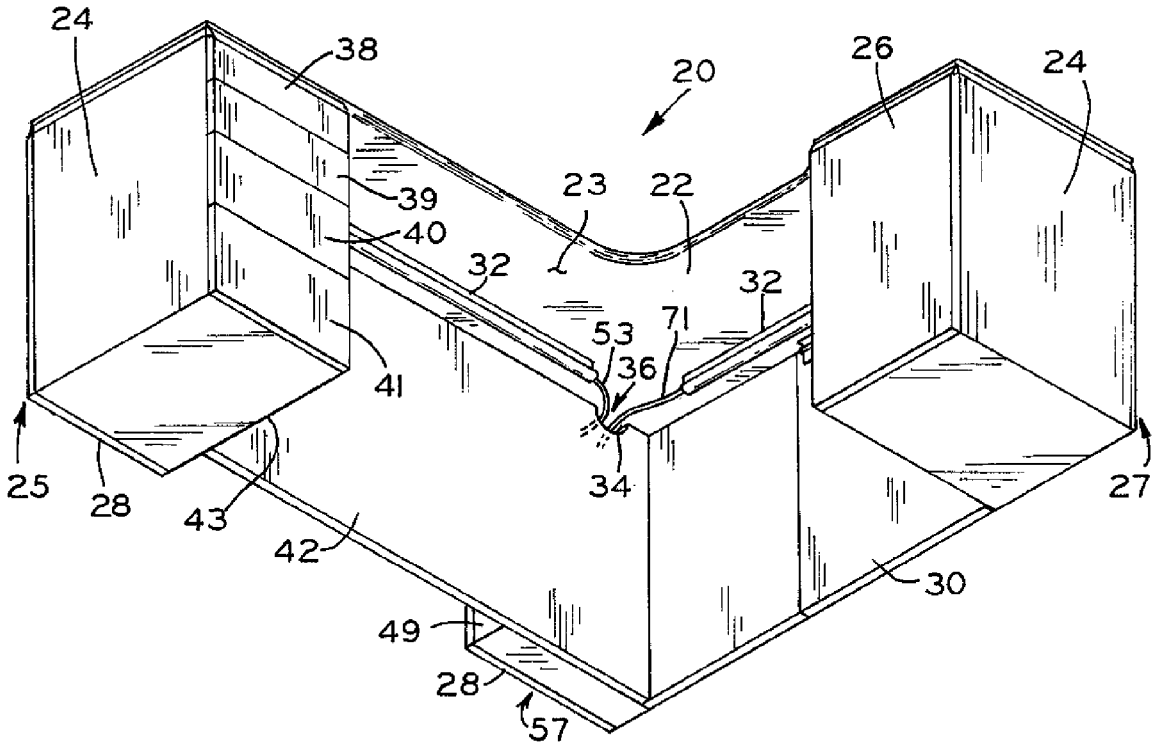
FIG. 2 is a bottom perspective view of the desk of FIG. 1.
Figure 8:
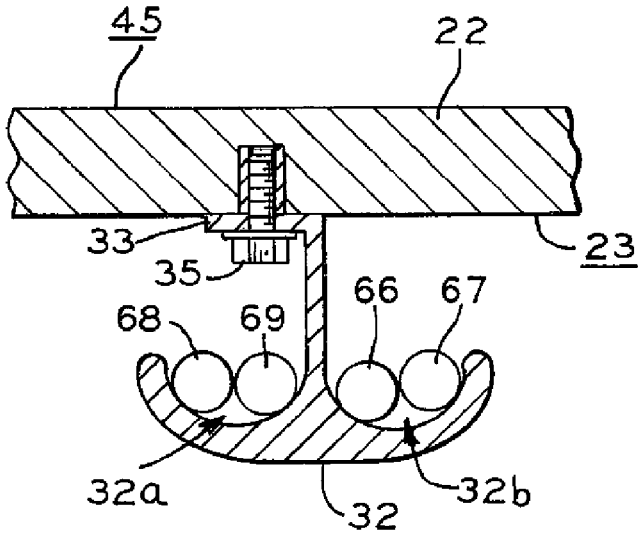
FIG. 8 is a cross-sectional view of a cord trough.

Referring to FIG. 2, work surface 22 includes bottom surface 23 upon which may be mounted at least one cord or cable trough 32. Cord trough 32 may include troughs 32*a* and 32*b* (FIG. 8) to facilitate holding cords or cables, for example, cords 66, 67, 68, and 69 (FIG. 8), above a floor surface. Cords 66, 67, 68, and 69 may be associated with various electronic items on top surface 45 or beneath work surface 22, for example. For the purposes of this document, cords and cables are meant to refer to any device which provides power, service, e.g., phone service, or any other function related to office or home office casegoods, e.g., USB and other communication cables. Cables or cords may also include rope or cables associated with security devices for locking valuable items on work surface 22 and preventing removal therefrom. As shown in FIG. 8, cord trough 32 may be secured to bottom surface 23 of work surface 22 via fastener 35 disposed through portion 33 of cord trough 32. Alternatively, cord trough 32 may be secured to bottom surface 23 via a suitable adhesive or a suction-type device. In one embodiment, cord trough 32 may be formed of a rigid or flexible plastic or of metal.

Figure 3:
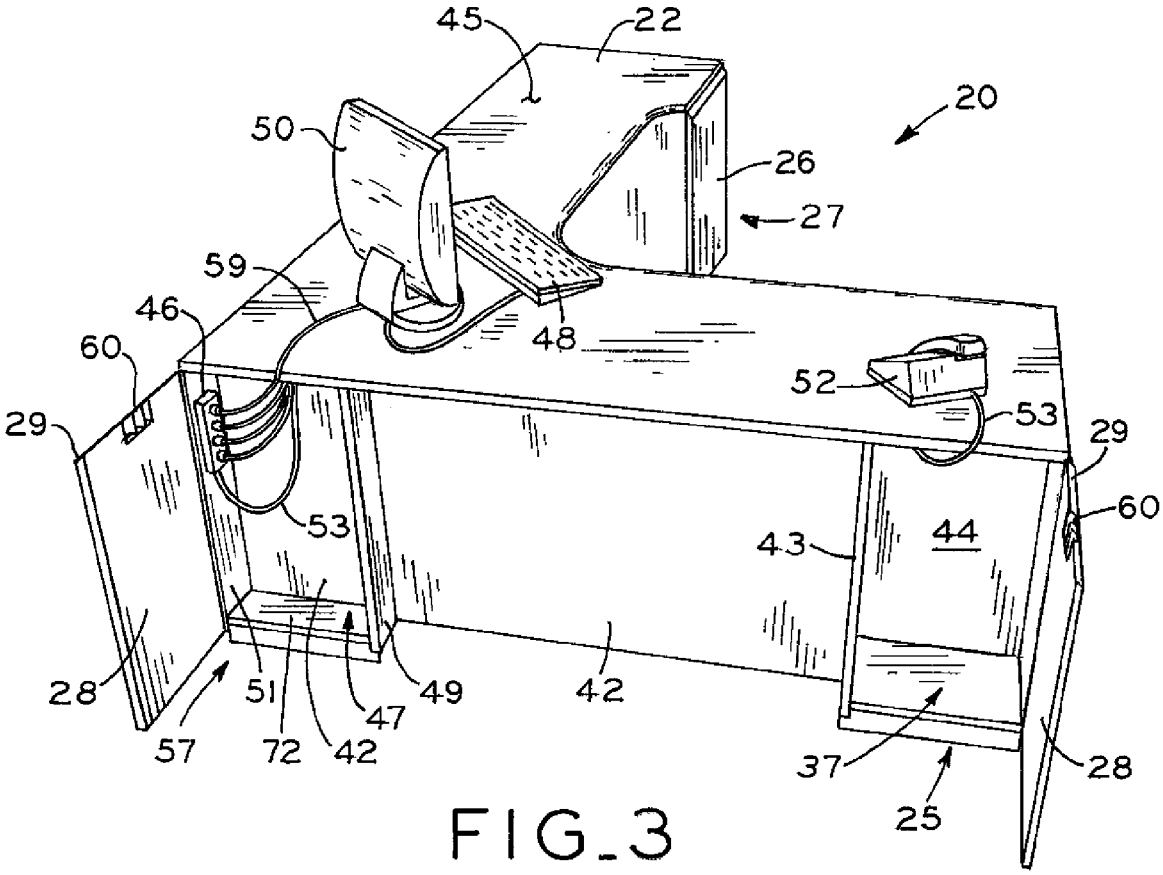
FIG. 3 is a perspective view of the desk of FIG. 1, further illustrating opened hinged access doors.

Referring now to FIGS. 2 and 3, pedestal 25 includes side panel 24, side panel 43, and a plurality of drawers 38, 39, 40, and 41 for storage. Hinged access door 28 is disposed opposite the front faces of drawers 38, 39, 40, and 41 on a backside of pedestal 25. Security panel 44 is disposed behind drawers 38, 39, 40, and 41 to provide a barrier to prevent access to drawers 38, 39, 40, and 41 upon opening hinged access door 28. Cable management space 37 of pedestal 25 is defined between hinged access door 28 and security panel 44. Hinged access door 28 may include any type of known hinges (not shown), such as a continuous piano hinge or one or more separate hardware hinges, to allow hinged access door 28 to open relative to desk 20, as shown in FIG. 3.

Referring still to FIGS. 2 and 3, pedestal 57 includes side panel 49, side panel 51, and hinged access door 28. Back panel 42 extends from side panel 43 to side panel 51. Cable management space 47 of pedestal 57 is defined between hinged access door 28 and back panel 42. Hinged access door 28 may include any type of known hinges (not shown), such as a continuous piano hinge or one or more separate hardware hinges, to allow hinged access door 28 to open relative to desk 20, as shown in FIG. 3. Cable management space 47 may include power strip 46 or other power supply device mounted on panel 51. Power strip 46 may include at least one phone outlet for receiving phone cords and also may include other outlets for receiving non-power related cords and cables, e.g., a USB cable. In an exemplary embodiment, power strip 46 is mounted with suitable fasteners such as screws or adhesive, on panel 51 near work surface 22. Alternatively, power strip 46 may be mounted within cable management space 47 on bottom surface 23 of work surface 22, side panel 49, bottom panel 72, or back panel 42. Advantageously, positioning and/or mounting power strip 46 inside cable management space 47 removes the need to place power strip 46 on a floor surface near desk 20, and advantageously permits easy access to power strip 46 for connecting a plurality of electronic implements to a power source while concealing power strip 46 with associated plugs from a user.

Figure 4:
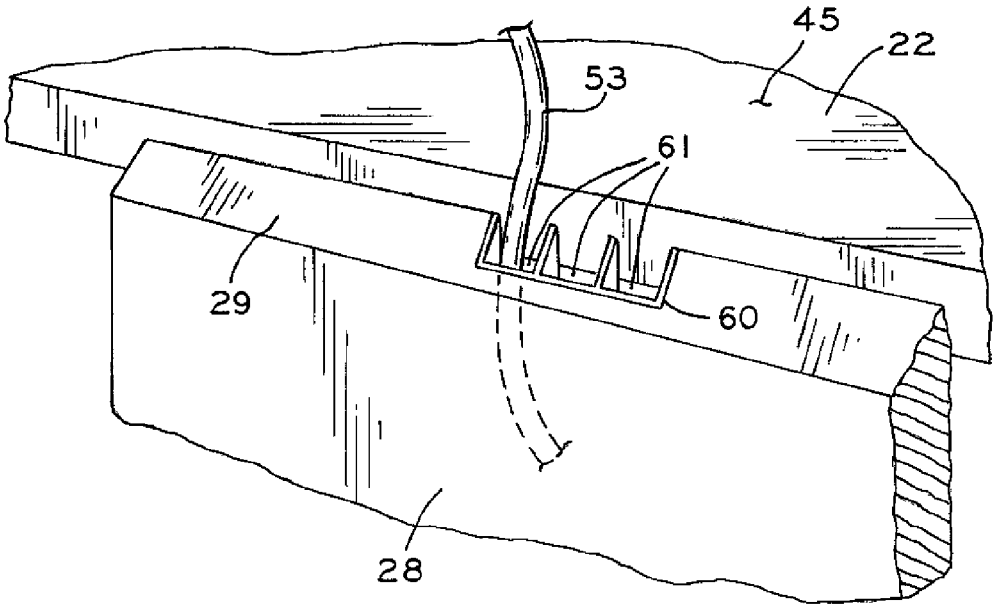
FIG. 4 is a fragmentary view of a portion of a hinged access door of FIG. 1, further illustrating the cable management grommet disposed therein.
Figure 12:
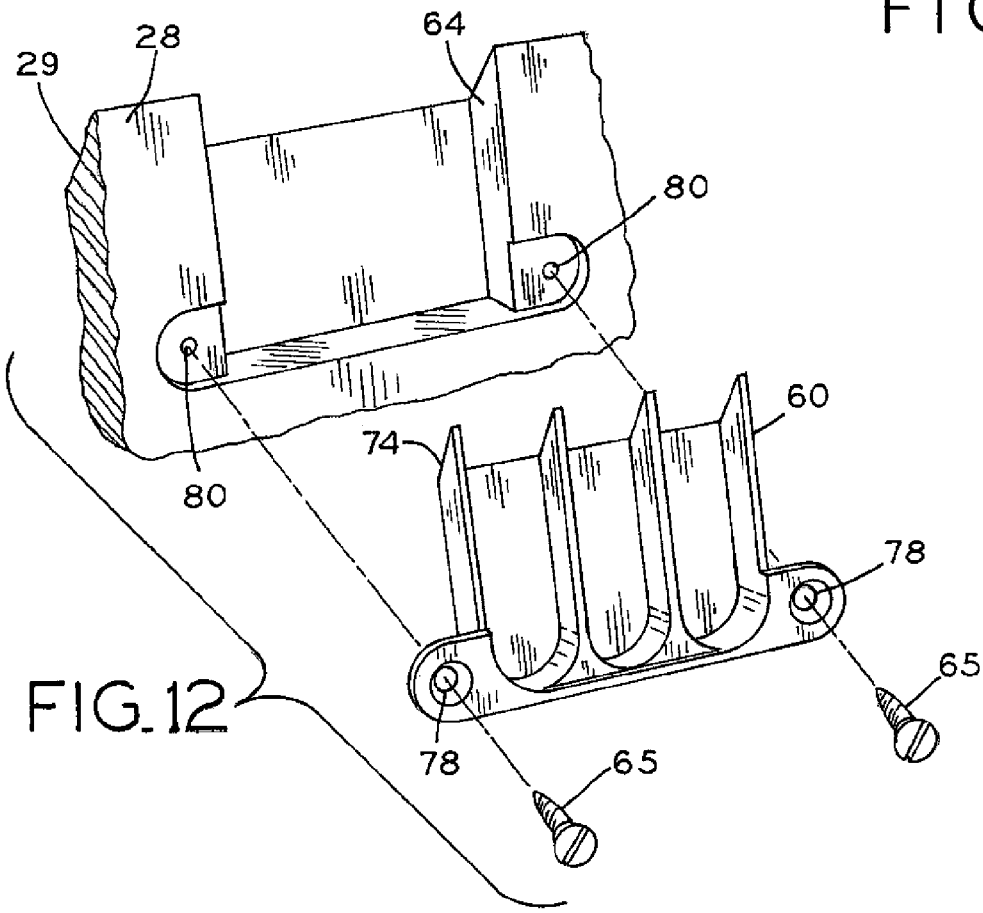
FIG. 12 is an exploded fragmentary view of the cable management grommet and hinged access door of the desk of FIG. 1.

As shown in FIGS. 3 and 4, each hinged access door 28 may include at least one cable management device, for example, grommet 60, wherein each cable management grommet 60 may include at least one cable management grommet aperture or opening 61. The cable management device may be selected to be any suitable structure to facilitate passage of cables or cords therethrough. Referring to FIG. 12, cable management grommet 60 is shown in exploded view before assembly with hinged access door 28. Hinged access door 28 may include recess 64 formed in door 28 via routing, for example. Recess 64 is shaped to accept cable management grommet 60 therein. Cable management grommet 60 may be formed of plastic or metal. Cable management grommet 60 is inserted into recess 64 and attached to hinged access door 28 via fasteners, such as a suitable adhesive or screws 65 inserted through apertures 78 in grommet 60 and into apertures 80 provided in door 28, for example. Alternatively, grommet 60 forms a press-fit engagement with recess 64. Grommet 60 may include beveled edge 74 which substantially matches the bevel of top edge 29 of door 28, thereby advantageously facilitating concealment of grommet 60 from a user of desk 20. Although not shown, grommet 60 may be disposed in a vertical side edge or a bottom edge of door 28.

Figure 5:
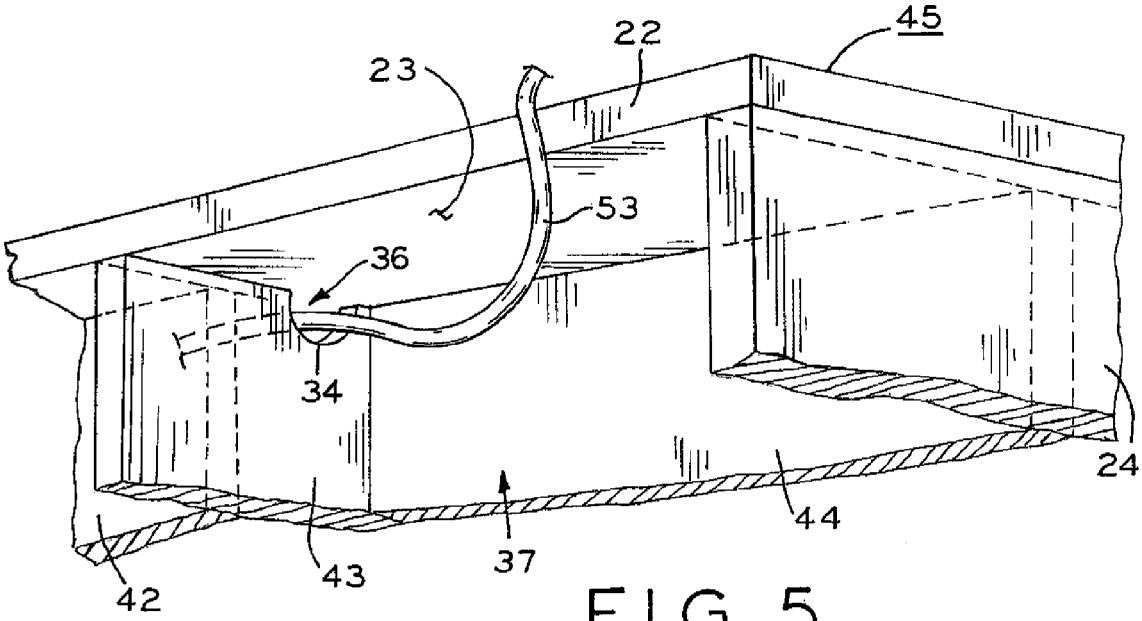
FIG. 5 is a fragmentary view of a portion of the desk of FIG. 3, further illustrating a half-round cord opening.
Figure 6:
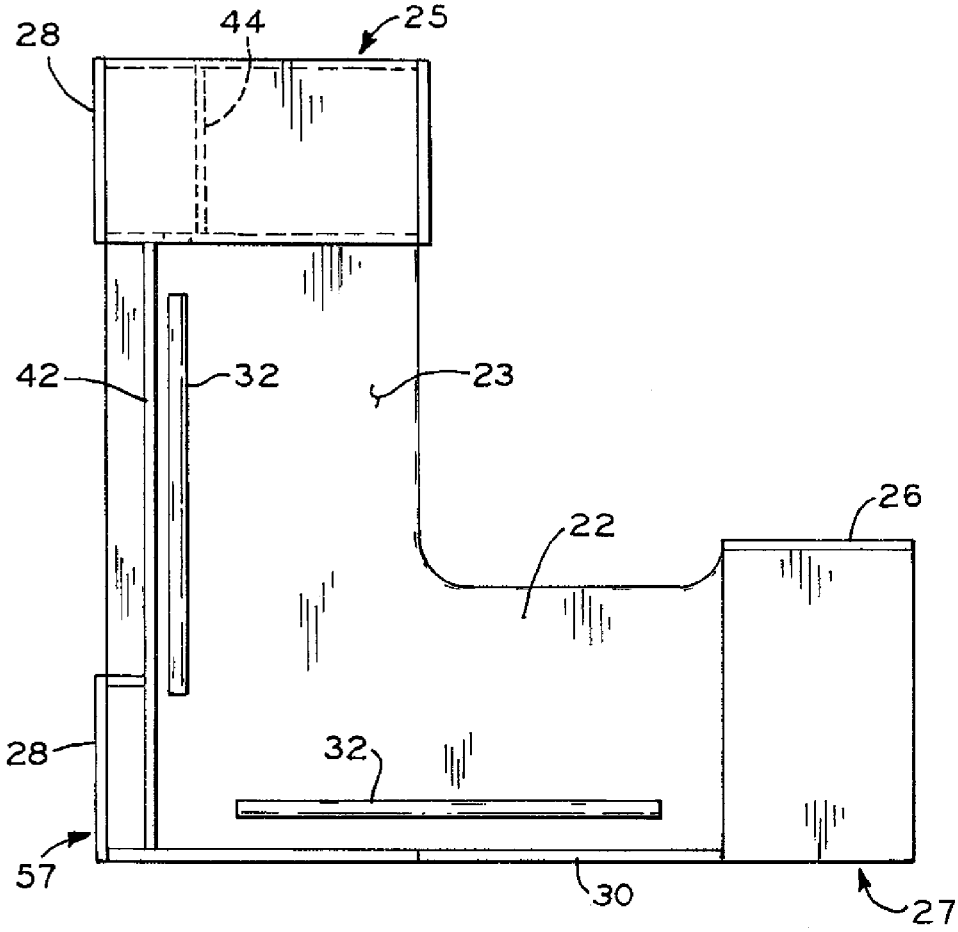
FIG. 6 is a bottom plan view of the desk of FIG. 1, further illustrating two cord troughs.

Referring now to FIGS. 3-5, cable management grommet 60 advantageously provides a path for cables, such as phone cord 53, to pass through a cable management grommet aperture 61 and into cable management space 37 when hinged access door 28 is closed. Cable management grommet 60 advantageously provides easy routing of cables or cords from the exterior of desk 20 to an interior of desk 20 while providing aesthetic advantages. For example, because cable management grommet 60 is disposed in top edge 29 of each hinged access door 28 and top edge 29 is typically not visible by a user seated in front of computer monitor 50, cable management grommet 60 is advantageously hidden from such a user. Although illustrated with phone cord 53, cable management grommet 60 may advantageously be used for any cord or cable extending from a work-related item or machine on top surface 45 of work surface 22, such as cords 70 and 71 (FIG. 7), for example. In use, phone cord 53 may be extended into cable management space 37 while hinged access door 28 is open, and then hinged access door 28 is closed with one cable management grommet aperture 61 lining up with phone cord 53 to permit complete closing of hinged access door 28. Advantageously, the hinged mounting of door 28 allows a cable with a relatively large plug to be easily placed in an aperture 61 without requiring pass through of the plug through aperture 61, i.e., when door 28 is open, the plug portion is placed inside the cable management space and then only the narrow portion of the cable is aligned with an aperture 61 after which door 28 is closed.

Referring still to FIGS. 3-5, once cord 53 is routed into cable management space 37 via cable management grommet aperture 61 (FIG. 4), panel 43 may include half-round cutout 34 (FIG. 5) forming half-round cord opening 36 through which cord 53 (FIG. 5) traverses vertical panels in desk 20 to facilitate routing of cord 53 into cord trough 32 (FIG. 2) disposed proximate pedestal 25 on bottom surface 23. As shown in FIG. 2, cord 53 travels along cord trough 32 and may enter cable management space 47 via another half-round cord opening 36 disposed in back panel 42. As shown in FIG. 3, once inside cable management space 47, cord 53 may be plugged into power strip 46 disposed within cable management space 47. In another example, as shown in FIG. 3, cord 59 extending from computer monitor 50 may enter cable management space 47 directly via cable management grommet 60 of hinged access door 28 of pedestal 57 and be plugged into power strip 46. Alternatively, a computer CPU unit (not shown) may be situated below work surface 22, for example, on a floor surface, and have a plurality of cords or cables extending therefrom. In such a situation, the cords or cables may be routed along cord trough 32 and enter cable management space 47 via half-round cord opening 36 in back panel 42 (FIG. 2). From space 47, these cables may either be plugged into power strip 46 or be guided through an aperture 61 of grommet 60 and plugged into computer monitor 50, for example, or another device associated with the computer.

Figure 9:
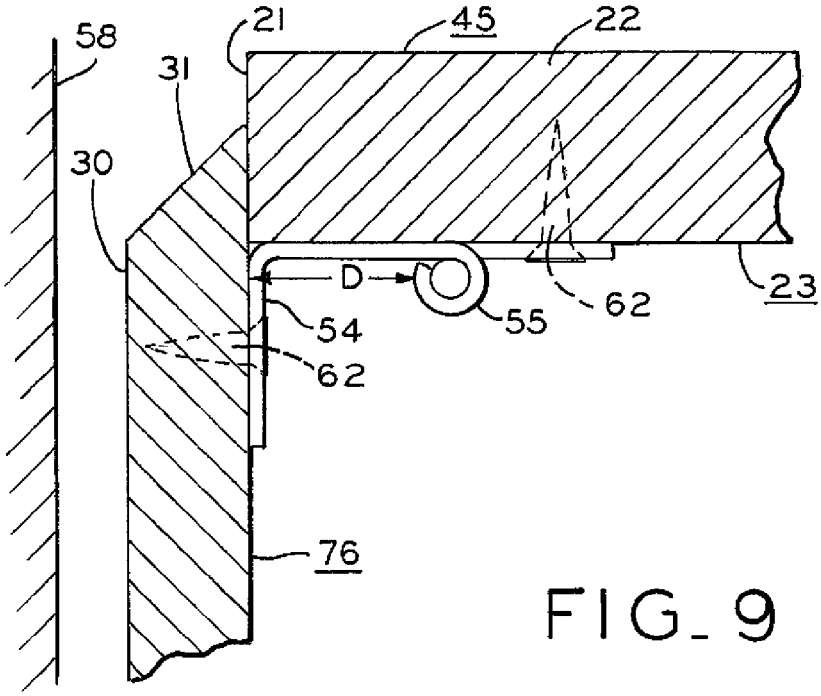
FIG. 9 is a partial cross-sectional view of the modesty panel and work surface of FIG. 7 taken along line 9-9 thereof, further illustrating the hinge connecting the modesty panel to the bottom side of the work surface.
Figure 10:
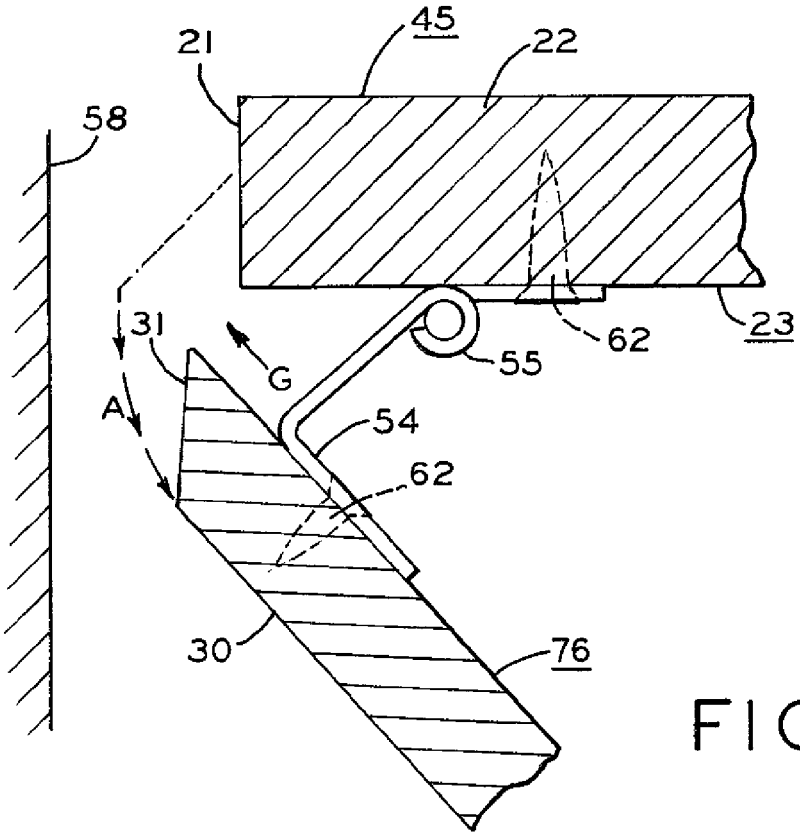
FIG. 10 is a partial cross-sectional view of the modesty panel and work surface of FIG. 9, further illustrating the modesty panel moved to an open position.
Figure 11:
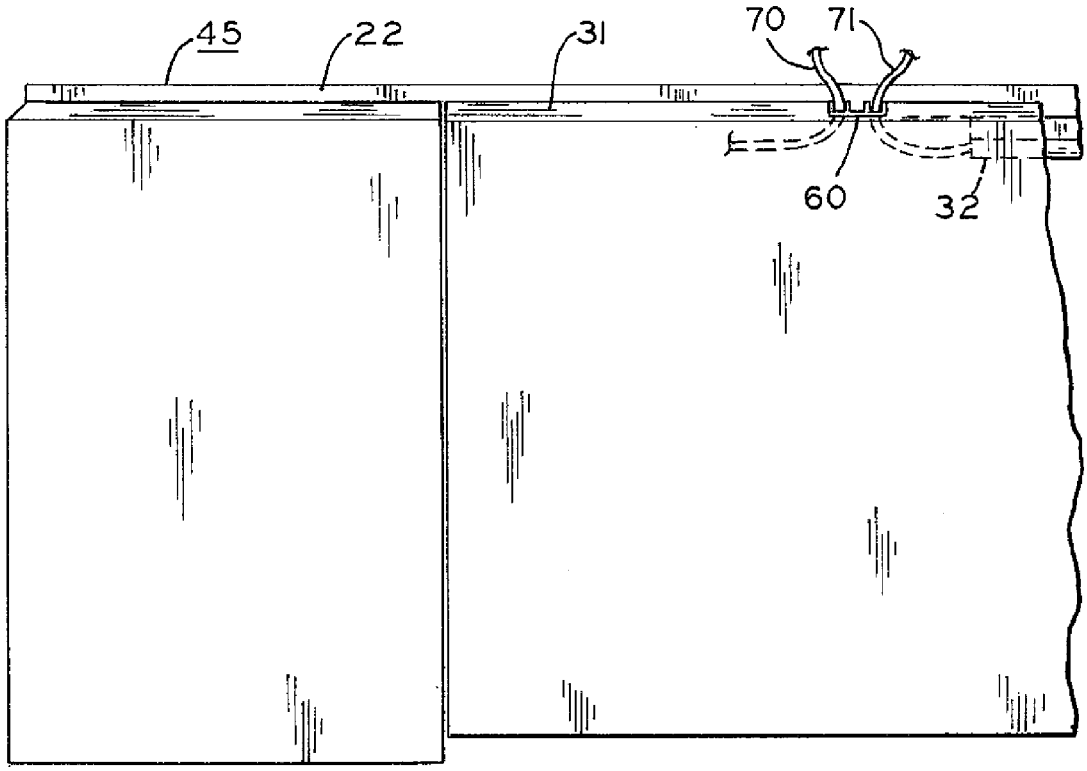
FIG. 11 is a fragmentary perspective view of the desk of FIG. 1, further illustrating the modesty panel.

Referring now to FIGS. 7 and 9-11, desk 20 may include modesty panel 30. Modesty panel 30 may similarly include cable management grommet 60 with cable management grommet apertures 61 in top edge 31 of modesty panel 30. As best shown in FIGS. 9-11, top edge 31 of modesty panel 30 is not visible by a user seated in front of computer monitor 50, and, therefore, cable management grommet 60 is advantageously not visible by such a user. Cables or cords from desk implements may enter cable management grommet 60 in modesty panel 30 in a similar fashion as that described above with respect to cable management grommet 60 disposed in hinged access door 28. Once cables or cords are routed through cable management grommet 60 in modesty panel 30, cord trough 32 may be advantageously employed to prevent the cables or cords from falling on the ground. Referring to FIGS. 2, 3, and 11, in one embodiment, cord 71 may be routed through cable management grommet 60 to a space below work surface 22. Cord 71 then may traverse along cord trough 32 and enter cable management space 47 (FIG. 3) via half-round cord opening 36 in back panel 42 (FIG. 2) to be plugged into power strip 46 or guided along troughs 32 and/or openings 36 in the remainder of desk 20 for eventual traversing of an aperture 61 and connection to an implement on top surface 45. In another embodiment shown in FIG. 7, cords 70 and 71 may be routed through cable management grommet 60 in modesty panel 30 and plugged into wall outlet 63, shown in dashed lines, located behind modesty panel 30 in wall 58 (FIGS. 9-10). Alternatively, cord 70 may be routed through cable management grommet 60 and plugged into wall outlet 63, as described above with respect to FIG. 7, and cord 71 may be routed along cord trough 32 to be plugged into power strip 46 or another electronic connection.

Figure 7:
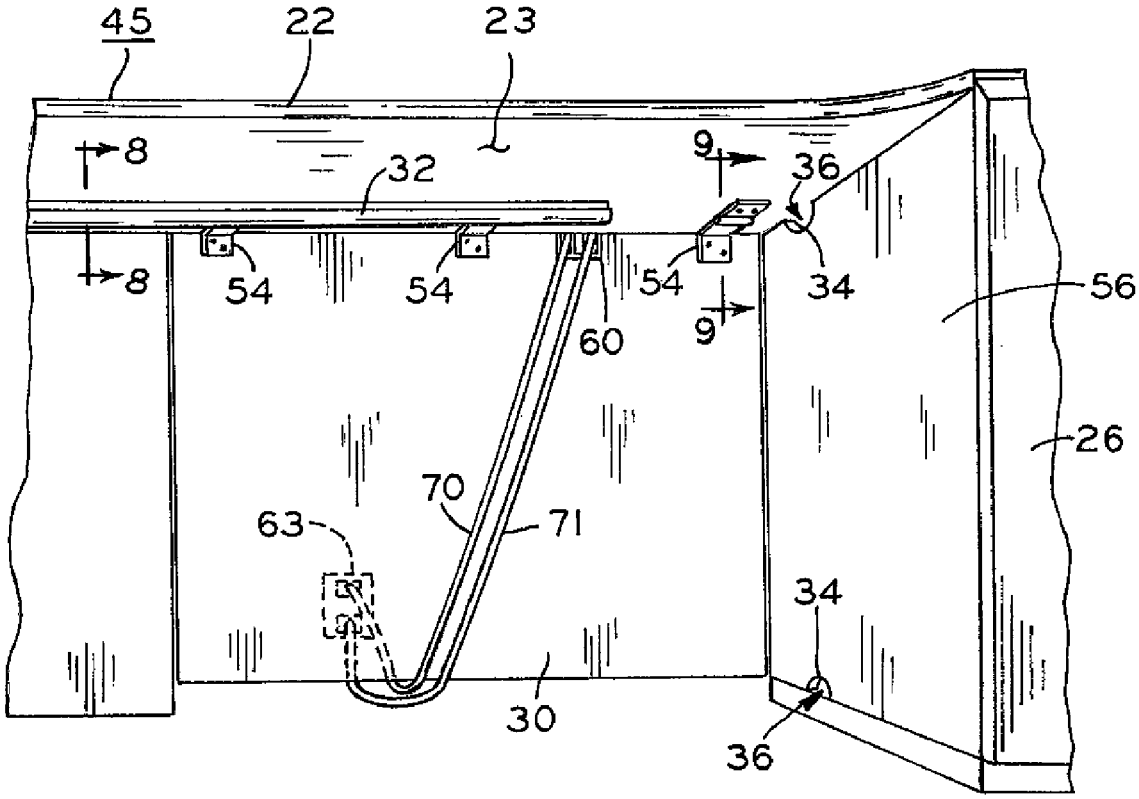
FIG. 7 is a fragmentary view of a portion of the desk of FIG. 1, further illustrating the modesty panel and associated hinges.

Referring now to FIGS. 7, 9, and 10, modesty panel 30 advantageously includes at least one hinge 54 secured to both bottom surface 23 of work surface 22 and interior surface 76 of modesty panel 30 via fasteners 62 to facilitate access to wall outlet 63 in wall 58. Alternatively, hinge 54 is secured to bottom surface 23 and modesty panel 30 via a suitable adhesive. Hinge 54 includes offset hinge or rotation point 55 disposed a short distance D from interior surface 76 of modesty panel 30 and edge 21 of work surface 22. The foregoing advantageously permits modesty panel 30 to be pivoted away and downwardly with respect to work surface 22, as shown in FIG. 10, without contacting wall 58, wherein modesty panel 30 is pivoted about a circle having a center located at hinge point 55. The location of offset hinge or rotation point 55 permits desk 20 to be placed immediately proximate wall 58 and still allow modesty panel 30 to be hingedly pivoted between a first, substantially vertical, closed position and a second access position. In operation, a user lifts modesty panel 30 near the floor surface and rotates modesty panel 30 in the direction denoted by arrow A, as shown in FIG. 10. The foregoing hinge arrangement of modesty panel 30 advantageously allows a user to access wall outlet 63 disposed in wall 58 without difficulty, i.e., without completely removing modesty panel 30 from desk 20 or sliding desk 20 away from wall 58 prior to rotating modesty panel 30. Additionally, when modesty panel 30 is rotated as shown in FIG. 10, a gap G is created between modesty panel 30 and work surface 22 which is large enough to permit passage of cords and cables with associated plug heads therethrough. Once these cords and cables are passed through, they can be positioned within apertures 61 in grommet 60 to allow complete closure of modesty panel 30 to a closed position, as shown in FIG. 9.

Figure 13:
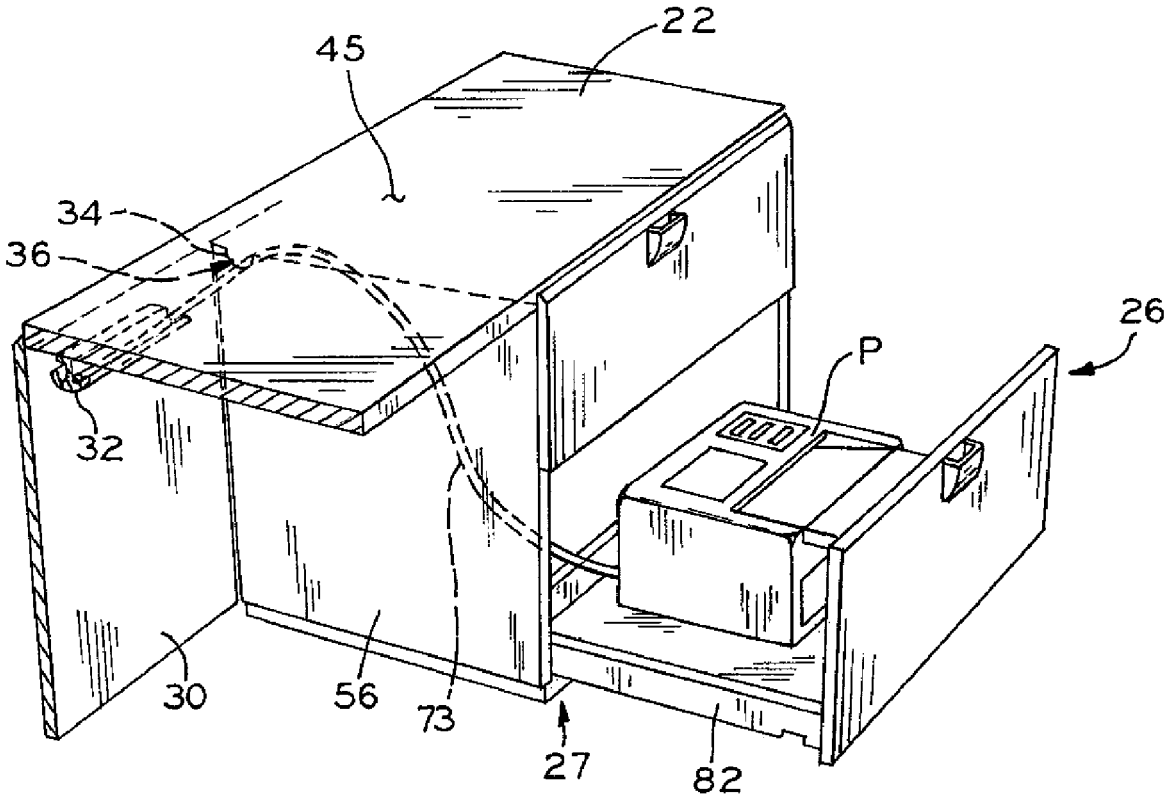
FIG. 13 is a fragmentary perspective view of the desk of FIG. 1, further illustrating the printer drawer and printer pedestal.

Referring to FIG. 13, pedestal 27 may include printer drawer 26, which is configured as a drawer having a flat base upon which a printer P is positioned, and a drawer front for advantageously concealing printer P within pedestal 27 when printer drawer 26 is closed. Drawer 26 includes a pair of known drawer slide mechanisms 82 to facilitate opening and closing of drawer 26. Cable 73 extending from printer P may be routed through half-round cord opening 36 in panel 56 and then routed into a trough 32. Cable 73 may traverse along trough 32 and through various half-round cord openings 36 in vertical panels and subsequently plugged into the computer CPU unit (not shown) situated on the floor surface below work surface 22 or subsequently routed through an aperture 61 in a grommet 60 and plugged directly into computer 50 (FIG. 3). In one embodiment, cable 73 may traverse along trough 32 until being routed through an aperture 61 in grommet 60 in modesty panel 30 and then plugged into wall outlet 63 (FIG. 7). Alternatively, pedestal 27 may also include a hinged access door (not shown) similar to door 28 described above with respect to pedestals 25 and 57. The hinged access door may define a cable management space in which cable 73 may be plugged into a communications or power receptacle device.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An article of furniture, comprising:

a work surface having an exposed top surface, an opposite lower surface, and a vertical edge;

at least one pedestal connected to the lower surface, said pedestal including a plurality of vertical panels at least partially enclosing an interior space within said pedestal that is disposed beneath said work surface;

an access door vertically hingedly connected to one of said vertical panels via at least one hinge for movement about a vertical axis between an open position allowing access to said interior space and a closed position restricting access to said interior space, said access door including an upper edge that, when said door is in said closed position, is horizontally adjacent with and abuts said vertical edge of said work surface; and a cable management device disposed within a recess extending into said upper edge of said access door, said cable management device including at least one opening which, when said access door is in said closed position, is disposed horizontally adjacent said work surface vertical edge and is accessible along a vertical direction.

2. The article of furniture of claim 1, wherein said upper edge of said access door comprises a beveled edge, said cable management device also including a beveled edge substantially matching said beveled upper edge of said access door.

3. The article of furniture of claim 1, wherein at least some of said vertical panels include cord openings.

4. The article of furniture of claim 1, further comprising at least one cable management trough attached to a bottom surface of said work surface.

5. The article of furniture of claim 1, wherein said cable management device includes a plurality of openings.

6. The article of furniture of claim 1, further comprising a cable management space defined by said vertical panels and said access door, said cable management space including an electronic receptacle mounted to one of said vertical panels and said access door.

7. The article of furniture of claim 1, wherein said access door includes an exterior face opposite said interior space and said cable management device is spaced away from said exterior face of said access door.

8. An article of furniture, comprising:

a work surface having a bottom surface and a side edge;

at least one pedestal disposed below said work surface, said pedestal including a plurality of vertical panels at least partially enclosing an interior space within said pedestal beneath said work surface;

at least one drawer movably mounted within said interior space of said at least one pedestal;

a vertical security panel mounted within said interior space of said pedestal and having a top edge abutting said bottom surface of said work surface, said security panel dividing said interior space into a drawer-receiving space in which said at least one drawer is disposed, and an adjacent cable management space, said cable management space including an electrical receptacle disposed therein, said security panel substantially restricting access to said drawer-receiving space from said cable management space; and an access door vertically hingedly mounted to one of said vertical panels of said pedestal via at least one hinge for movement about a vertical axis, said access door movable between a closed position in which said access door closes said cable management space and an open position in which said cable management space is accessible; and a cable management device mounted within a recess extending into an upper edge of said access door, wherein said upper edge of said access door, when said door is in said closed position, is horizontally adjacent with and abutting said side edge of said work surface, said cable management device including at least one opening which, when said door is in said closed position, is disposed horizontally adjacent said work surface side edge and is accessible along a vertical direction.

9. The article of furniture of claim 8, further comprising at least one opening disposed within at least one of said vertical panels adjacent said cable management space.

10. The article of furniture of claim 8, wherein said cable management device includes a plurality of openings.

11. The article of furniture of claim 8, wherein said electronic receptacle is mounted to one of said vertical panels and said access door.

12. The article of furniture of claim 8, further comprising at least one cable management trough attached to a bottom surface of said work surface.

13. An article of furniture, comprising:

a work surface having a bottom surface and a vertical edge;

a substantially vertically disposed modesty panel, said modesty panel having a top edge and at least one hinge pivotally connecting said top edge of said modesty panel to said bottom surface of said work surface for pivotal movement about a horizontal axis from said substantially vertical position to another position in which said modestly panel is disposed inwardly beneath said work surface and is angled with respect to said substantially vertical position; and a cable management device mounted to said modesty panel within a recess extending into said top edge of said modesty panel, said cable management device including at least one opening which, when said modesty panel is in said substantially vertical position, is disposed horizontally adjacent said vertical edge of said work surface and is accessible along a vertical direction, wherein when said modesty panel is disposed in said substantially vertical position, a vertical top edge of said modesty panel is in vertical abutment with said vertical edge of said work surface.

14. The article of furniture of claim 13, further comprising at least one cable management trough attached to said bottom surface of said work surface adjacent said modesty panel.

15. The article of furniture of claim 13, further comprising a plurality of panels disposed below said work surface, said panels including a plurality of cord openings.

16. The article of furniture of claim 13, wherein said cable management device includes a plurality of openings.

17. The article of furniture of claim 13, wherein said pivotable modesty panel comprises a vertical interior surface, and said at least one hinge provides an offset hinge point, said offset hinge point spaced a distance from both said work surface vertical edge and from said vertical interior surface of said modesty panel to abut said bottom surface of said work surface, said modesty panel mounted via said at least one hinge for pivotal movement about said offset hinge point from said substantially vertical position, in which said vertical interior surface of said modesty panel is disposed vertically adjacent to said vertical side edge of said work surface, to another position angled with respect to, and spaced downwardly from, said substantially vertical position.

18. The article of furniture of claim 13, wherein said at least one hinge is connected to the article of furniture via a plurality of screws or an adhesive.

19. The article of furniture of claim 13, wherein said top edge of said modesty panel comprises a beveled edge forming an obtuse angle with said work surface vertical edge, said cable management device also including a beveled edge substantially matching said beveled top edge of said modesty panel.

20. The article of furniture of claim 13, said hinge further comprising a rotation point directly adjacent to the article of furniture and spaced from said modesty panel, said article of furniture positioned in a fixed position, and said modestly panel movable relative to said article of furniture.

* * * * *